US009677197B2

(12) United States Patent
Blankenhorn

(10) Patent No.: US 9,677,197 B2
(45) Date of Patent: Jun. 13, 2017

(54) SPINNING STATION OF A SPINNING PREPARATION MACHINE

(71) Applicant: Maschinenfabrik Rieter AG, Winterthur (CH)

(72) Inventor: Peter Blankenhorn, Gerstetten (DE)

(73) Assignee: Maschinenfabrik Rieter AG, Winterthur (CH)

( * ) Notice: Subject to any disclaimer, the term of this patent is extended or adjusted under 35 U.S.C. 154(b) by 142 days.

(21) Appl. No.: 14/428,112

(22) PCT Filed: Sep. 10, 2013

(86) PCT No.: PCT/IB2013/001963

§ 371 (c)(1),
(2) Date: Mar. 13, 2015

(87) PCT Pub. No.: WO2014/041412

PCT Pub. Date: Mar. 20, 2014

(65) Prior Publication Data

US 2015/0240394 A1 Aug. 27, 2015

(30) Foreign Application Priority Data

Sep. 14, 2012 (DE) ..... 10 2012 108 613

(51) Int. Cl.
*D01H 5/28* (2006.01)
*D01H 7/92* (2006.01)
*D01H 1/115* (2006.01)

(52) U.S. Cl.
CPC ..... *D01H 5/28* (2013.01); *D01H 1/115* (2013.01); *D01H 7/92* (2013.01)

(58) Field of Classification Search
CPC ..... D01H 4/02; D01H 5/28; D01H 7/92
See application file for complete search history.

(56) References Cited

U.S. PATENT DOCUMENTS 7,647,760 B2 * 1/2010 Griesshammer ..... D01H 5/42 57/209
7,661,259 B2 * 2/2010 Griesshammer ..... D01H 1/115 57/209

(Continued)

FOREIGN PATENT DOCUMENTS

DE 32 37 989 A1 7/1983
DE 10 2007 006 674 A1 8/2008

(Continued)

OTHER PUBLICATIONS

PCT Search Report, Apr. 10, 2014.

(Continued)

*Primary Examiner* — Shaun R Hurley
(74) *Attorney, Agent, or Firm* — Dority & Manning, P.A.

(57) ABSTRACT

A spinning preparation machine for producing a roving from a fiber bundle includes a vortex chamber having an infeed opening for the fiber bundle and a yarn forming element extending at least partially into the vortex chamber. The spinning station includes spin nozzles, which lead into the vortex chamber in the region of a wall enclosing the vortex chamber and via which air is introduced into the vortex chamber in a specified direction of rotation in order to set the fiber bundle, which is fed in a transport direction, into rotation in the region of an inlet mouth of the yarn forming element. The yarn forming element includes a draw-off channel, which adjoins the inlet mouth and via which the yarn can be drawn out of the vortex chamber. The wall of the vortex chamber has a transition section, which adjoins the infeed opening, and has the shape of the circumferential surface of a truncated cone, and the diameter of which increases in the transport direction. The spin nozzles lead into the vortex chamber in the region of the transition section and each has a direction of flow that is oriented in the (Continued)

direction of an outer surface of the wall enclosing the vortex chamber.

10 Claims, 13 Drawing Sheets

(56) References Cited

U.S. PATENT DOCUMENTS

| | | | | |
|---|---|---|---|---|
| 2004/0016223 | A1* | 1/2004 | Stalder | D01H 1/115 57/400 |
| 2007/0144136 | A1* | 6/2007 | Griesshammer | D01H 5/42 57/315 |
| 2007/0193245 | A1 | 8/2007 | Griesshammer et al. | |
| 2008/0276594 | A1* | 11/2008 | Stahlecker | D01H 1/115 57/403 |

FOREIGN PATENT DOCUMENTS

| | | | |
|---|---|---|---|
| EP | 0 375 242 | A2 | 6/1990 |
| EP | 1 291 457 | A2 | 3/2003 |
| EP | 2 369 042 | A2 | 9/2011 |
| JP | 2003193337 | A | 7/2003 |

OTHER PUBLICATIONS

Article—Airflow Simulation in Nozzle for H airiness Reduction of Ring Spun Yarns. Part II: Influence of Nozzle Parameters. The Textile Institute, 2006, vol. 97, No. 1, pp. 97-101.

* cited by examiner

SPINNING STATION OF A SPINNING PREPARATION MACHINE

FIELD OF THE INVENTION

The present invention relates to a spinning station of a spinning preparation machine for producing a roving from a fiber bundle, wherein the spinning station includes a vortex chamber having an infeed opening for the fiber bundle fed in a transport direction and a yarn forming element extending at least partially into the vortex chamber. The spinning station includes spin nozzles, which are directed into the vortex chamber and which lead into the vortex chamber in the region of a wall enclosing the vortex chamber and via which air can be introduced into the vortex chamber in a specified direction of rotation in order to set the fiber bundle into rotation in the specified direction of rotation in the region of an inlet mouth of the yarn forming element. The yarn forming element includes a draw-off channel, which adjoins the inlet mouth and via which the yarn can be drawn out of the vortex chamber.

BACKGROUND

Roving is produced from slivers, which are usually pretreated (for example, doubled) by drafting and serves as the precursor for the subsequent spinning process, in which the individual fibers of the roving are spun, for example by means of a ring spinning machine, to form a fiber yarn. In order to give the roving the strength necessary for the further processing, it has proven to be advantageous, during production of the roving, to draft the supplied fiber bundle by means of a drafting system, which is usually part of the spinning preparation machine in question, and then to provide it with a protective twist. The aforementioned strength is important in order to prevent the roving from breaking during the winding onto a tube and/or during the feeding thereof to the downstream spinning machine. The applied protective twist must, on the one hand, be strong enough to ensure that a cohesion of the individual fibers during the individual winding and unwinding processes and corresponding transport processes between the respective types of machine is ensured. On the other hand, it must also be ensured that, despite the protective twist, the roving can be further processed in a spinning machine—the roving must therefore still be able to be drafted.

For producing such a roving, so-called flyers are preferably used, the delivery speed of which is nevertheless limited due to centrifugal forces that occur. There have therefore already been many proposals for circumventing the flyers or replacing them with an alternative type of machine (see, for example, EP 0 375 242 A2, DE 32 37 989 C2).

In this connection, it has also already been proposed, inter alia, to produce roving by means of air-jet spinning machines, in which the protective twist is created by means of airflows. The basic principle here consists in guiding a fiber bundle through a vortex chamber, in which an air vortex is generated. The latter finally effects that some of the outer fibers are wrapped as so-called wrapping fibers around the centrally extending fiber strand, which in turn consists of core fibers extending substantially parallel to one another.

Since the production of a roving fundamentally differs from the production of a conventional yarn (because yarn and roving differ significantly in terms of strength and draftability), it is not possible to use known air-jet spinning machines to produce a roving. Rather, the dimensions and/or geometry of the spinning station of a spinning preparation machine must be selected independently of the known prior art.

SUMMARY OF THE INVENTION

A problem addressed by the present invention is therefore that of providing a spinning station for an air-jet spinning machine used to produce roving, with which it is possible to produce a particularly high-quality roving. Additional objects and advantages of the invention will be set forth in part in the following description, or may be obvious from the description, or may be learned through practice of the invention.

The problems are solved by a spinning station having the features set forth herein.

According to the invention, the spinning station is characterized in that the wall of the vortex chamber has a transition section, which adjoins the infeed opening of the vortex chamber, widens in the transport direction, and has the shape of the circumferential surface of a truncated cone. Moreover, it is provided that the spin nozzles lead into the vortex chamber in the region of the transition section, and each have a direction of flow that is oriented in the direction of the wall enclosing the vortex chamber. This ensures that an airflow can be produced by means of the spin nozzles, which extends largely into the gap that is present between the yarn forming element and the aforementioned wall and therefore impacts, from the outside, the fibers and/or fiber ends of the fiber bundle enclosing the yarn forming element and thereby produces the desired protective twist.

In other words, the invention provides that the spin nozzles do not enter in the region of a cylindrical section or a stepped annular edge. Instead, a conical region is provided next to the infeed opening, which effects a cross-sectional expansion of the vortex chamber outwardly from the infeed opening and functions as an air-outlet region of the spin nozzles. The fact that the transition section adjoins the infeed opening does not necessarily mean that there must be a direct transition between the infeed opening and the transition section (even if such a design appears to be absolutely advantageous). Rather, it is also possible, of course, for an additional intermediate section to be located between the infeed opening and the transition section.

Independently thereof, the spin nozzles should lead into the vortex chamber such that the outlet openings thereof transition into the transition section on all sides. In this manner it is ensured that the spin nozzles still always lead into the vortex chamber in entirety, in region of the transition section, even if there is an unwanted, production-related, lateral displacement.

According to a development of the invention, it is advantageous when the transition section transitions into a cylindrical section in the transport direction of the fiber bundle. In this connection, the transition can take place continuously or in a stepped manner, i.e., directly. In addition, the cylindrical section should have a length in the transport direction of the fiber bundle that is greater than the diameter of the cylindrical section in this region in order to ensure a particularly homogeneous airflow. Finally, one or more additional sections can adjoin the cylindrical section (as viewed in the transport direction), the shape of which corresponds to the shape of a cylinder. A section is conceivable, for example, having a shape—comparable to the shape of the transition section according to the invention—which corresponds to the circumferential surface of a truncated cone.

Particular advantages are achieved when, in a sectional view extending parallel to the respective longitudinal axis and parallel to the longitudinal axis of the draw-off channel, the longitudinal axis of each spin nozzle encloses an angle $\alpha$ with the longitudinal axis of the draw-off channel having a value between 75° and 40°. Within this range, the airflow generated by the spin nozzles is oriented so as to induce a particularly homogeneous protective twist. An extraordinarily high-quality roving can be produced when the aforementioned value is between 70° and 50°, wherein a value of 60° has proven to be particularly favorable.

It is also extremely advantageous when the circumferential line of the transition section encloses an angle $\beta$ with the longitudinal axis of the draw-off channel, the angle $\beta$ having a value between 80° and 15°. In this connection, the circumferential line is defined as a line that lies on the surface of the transition section and in a common plane with the longitudinal axis of the draw-off channel. In particular, it has proven to be advantageous when the aforementioned angle has a value between 50° and 20°, since an airflow is generated in this case (which depends, inter alia, on the shape and orientation of the inner surface of the vortex chamber forming the transition section), which can be used to impart a particularly consistent protective twist to the fiber bundle. According to the current state of knowledge, an angle of 30° is preferred. Furthermore, it has proven to be particularly advantageous when the sum of the values of the aforementioned angles ($\alpha$ and $\beta$) yields a value between 75° and 105°, preferably a value of 90°.

In addition, it is advantageous when the spin nozzles each extend, in a sectional view extending perpendicularly to the longitudinal axis of the draw-off channel, between the longitudinal axis of the draw-off channel and a tangent line of the wall of the vortex chamber. In other words, it is therefore advantageous when the spin nozzles do not lead into the vortex chamber directly tangentially, as is common for known spinning stations that are used to produce a finished yarn. Rather, the spin nozzles in the aforementioned sectional view should be directed into the gap that is formed between the wall of the vortex chamber and the outer surface of the yarn forming element. In this case, the spin nozzles do not continuously transition into the aforementioned wall. Rather, the transition between the inner walls of the spin nozzles and the inner wall of the transition section occurs in the shape of a certain bent edge.

It is advantageous when the longitudinal axes of the spin nozzles each extend in a section extending perpendicularly to the longitudinal axis of the draw-off channel, parallel to a tangent line of the wall of the vortex chamber. In particular, it can be advantageous when the longitudinal axes of the spin nozzles each lie, in a sectional view extending perpendicularly to the draw-off channel, on a line that extends closer to the draw-off channel than the longitudinal axes of spin nozzles that lead directly tangentially into the vortex chamber.

It is also advantageous when the transition section has a diameter on the side thereof facing the infeed opening, which has a value between 14 mm and 8 mm. A diameter in this range ensures that the transition section—given the above-described orientation of the circumferential line—can undergo the desired diameter expansion in the transport direction of the fiber bundle and thereby assume a diameter that results in the desired curvature of the wall of the vortex chamber. A diameter is preferred, in particular, that has a value between 12 mm and 9 mm, wherein a value of 10 mm has proven to be particularly advantageous.

It is also advantageous when the transition section has a diameter on the side thereof facing the infeed opening, which has a value between 16 mm and 10 mm. In particular, when the transition section transitions directly into a subsequent cylindrical section, the aforementioned diameter also determines the diameter of the major portion of the vortex chamber (and/or the section thereof in the region of the inlet mouth of the yarn forming element). The selection of the diameter therefore directly influences the "curvature" of the swirled air and, therefore, the intensity with which the fiber ends captured by the swirled air are bent (reference is also made in this regard to the following details of the outer diameter of the yarn forming element). In the end, values have proven advantageous that are between 14 mm and 11 mm, wherein a value of 12.5 mm is particularly suitable.

It is particularly advantageous when the yarn forming element has a cylindrical outer contour in the region of the cylindrical section of the vortex chamber. If the wall of the vortex chamber in the region of the cylindrical outer contour of the yarn forming element simultaneously has a cylindrical course (i.e., the wall and the outer contour of the yarn forming element extend concentrically across a certain region), an annular gap having a constant flow cross-section forms. Finally, a swirled airflow can be generated within the annular gap, by means of which the desired protective twist can be produced in a particularly reliable and consistent manner.

It is also advantageous when the yarn forming element has an outer diameter, at least in the region in which the yarn forming element has a cylindrical outer contour, which is between 5 mm and 14 mm, preferably between 10 mm and 11.5 mm. It has been shown, for example, that a portion of the fibers disposed without full protection in the interior of the fiber bundle can be captured by the airflow, in particular, in the region of the inlet mouth of the yarn forming element and the adjoining region having the cylindrical outer contour. These are pulled partially out of the fiber bundle and are finally wound around the respective inner "core fibers" such that, in the end, the desired protective twist is produced. The extent to which the fibers are bent in this case depends, in particular, on the outer diameter of the yarn forming element in the region of the aforementioned cylindrical section, which preferably extends up to the region of the end face of the yarn forming element having the inlet mouth. A smaller outer diameter therefore induces a greater bend, while a larger outer diameter results in an only relatively slight bending of the fiber ends. If the outer diameter of the yarn forming element is selected as indicated above, the yarn forming element has an outer circumferential surface in the region of the cylindrical section thereof that results in an optimum angular velocity of the swirled air generated by the air flowing into the vortex chamber. A smaller diameter would ultimately result in a higher angular velocity, while an outer diameter greater than 14 mm would result in an insufficient bending of the fibers and, therefore, a faulty protective twist.

It is particularly advantageous when the draw-off channel has an inlet mouth, in the region of the vortex chamber, for the roving to be pulled out of the vortex chamber, inlet mouth having a diameter between 4 mm and 12 mm, preferably between 6 mm and 8 mm. Within the aforementioned diameter limits, a particularly advantageous airflow occurs in the region of the inlet mouth of the yarn forming element, which effects that only a portion of the outer fiber ends are captured and are wound around the actual fiber core with the desired strength. If the diameter is less than 4 mm, however, this gradually enters the range that is known from conventional air-jet spinning and that results in a relatively strong yarn, which is only conditionally suitable for use as roving. If a diameter greater than 12 mm is selected, however, the air pressure of the air supplied via the air nozzles must be significantly increased in order to ensure the necessary swirled airflow within the vortex chamber, since a portion of the inflowing air exits the vortex chamber via the inlet mouth of the yarn forming element without contributing to the vortex formation. Therefore, it is also possible, in principle, to produce a roving with a yarn forming element having an inlet mouth with a diameter that is outside the range according to the invention. A particularly advantageous roving can only be produced, however, when the diameter deviates significantly from the values known from conventional air-jet spinning, which are between 0.5 and a maximum of 2.0 mm, said roving being characterized in that a portion of the fibers are wrapped, as wrapping fibers, around the centrally disposed core fibers (and thereby provide the roving with a protective twist), wherein the portion and the strength of the wrapping fibers is just high enough that the desired draft of the roving is still possible over the course of the subsequent spinning process.

BRIEF DESCRIPTION OF THE DRAWINGS

Further advantages of the invention are described in the following exemplary embodiments, in which.

DETAILED DESCRIPTION

Figure 1:
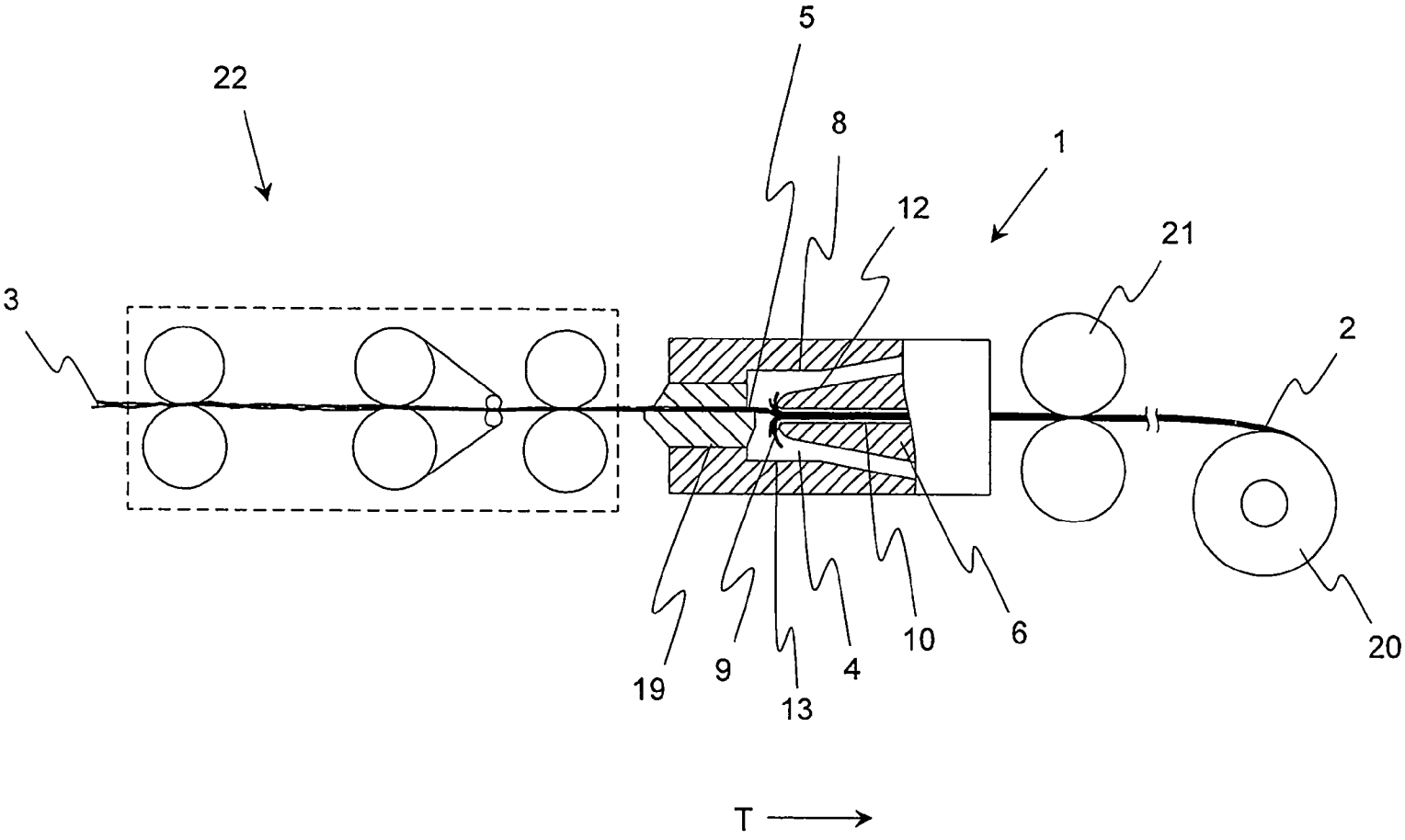
FIG. 1 shows a schematic view of a spinning preparation machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

First, it should be expressly noted that the illustrated parts of various spinning stations 1 and the upstream and downstream elements in FIG. 1 are not drawn to scale. Instead, the individual figures merely show schematic illustrations, which are intended to elucidate the basic design of the respective assemblies. In particular, the spacings, angles, and diameters that are indicated, in part, in the respective figures have values in the drawings that do not necessarily represent the most advantageous ranges.

FIG. 1 shows a schematic view of a part of a spinning preparation machine. The spinning preparation machine may, if necessary, comprise a drafting system 22, to which there is fed a fiber bundle 3, for example in the form of a doubled sliver. The illustrated spinning preparation machine also comprises, in principle, a spinning station 1, which is spaced apart from the drafting system 22 and has an internal vortex chamber 4, in which the fiber bundle 3 and/or at least a portion of the fibers of the fiber bundle 3 are provided with a protective twist (the exact mode of operation of the spinning station 1 is described in greater detail in the following).

The spinning preparation machine can also comprise a pair of draw-off rollers 21 and a winding device 20 (also schematically illustrated) for the roving 2, which is disposed downstream of the pair of draw-off rollers 21. The device according to the invention does not necessarily have to comprise a drafting system 22 as shown in FIG. 1. The pair of draw-off rollers 21 is not absolutely necessary either.

The spinning preparation machine operates according to a special air-jet spinning process. In order to form the roving 2, the fiber bundle 3 is guided in a transport direction T via an infeed opening 5 of a fiber guide element 19 (which is preferably designed as a separate component) into the vortex chamber 4 of the spinning station 1. There it receives a protective twist, i.e., at least a portion of the fibers of the fiber bundle 3 is captured by an airflow that is generated by appropriately placed spin nozzles 7. A portion of the fibers is thereby pulled at least a little way out of the fiber bundle 3 and is wound around the tip of a yarn forming element 6, which protrudes into the vortex chamber 4.

In terms of the spin nozzles 7, it is mentioned here merely as a precautionary measure that these should be typically oriented such that a unidirectional airflow having a uniform direction of rotation is generated. In this connection, the individual spin nozzles 7 are preferably disposed with rotational symmetry relative to one another (see FIG. 3, which shows a sectional illustration along the sectional surface A-A' in FIG. 2, wherein the spin nozzles 7, the greater part of which extends above the sectional surface and therefore cannot actually be seen, are illustrated using dashed lines). In terms of all the exemplary embodiments shown, it is should also be noted that the spin nozzles 7 each have a direction of flow that is oriented in the direction of a wall 8 enclosing the vortex chamber 4 such that the generated airflow extends at least largely in the form of a spiral between the outer surface 12 of the yarn forming element 6 and the wall 8 of the vortex chamber 4.

Finally, the fibers of the fiber bundle 3 are drawn out of the vortex chamber 4 via an inlet mouth 9 of the yarn forming element 6 and a draw-off channel 10, which is disposed inside the yarn forming element 6 and adjoins the inlet mouth 9. In doing so, the free fiber ends are finally also drawn on a helical trajectory in the direction of the inlet mouth 9 and wrap as wrapping fibers around the centrally extending fibers, resulting in a roving 2 which has the desired protective twist.

Due to the only partial twisting of the fibers, the roving 2 has a (residual) draftability which is essential for the further processing of the roving 2 in a downstream spinning machine, for example a ring spinning machine. Conventional air-jet spinning devices, on the other hand, give the fiber bundle 3 such a pronounced twist that the required drafting following the yarn production is no longer possible. This is also desired in this case since conventional air-jet spinning machines are designed to produce a finished yarn, which is generally intended to be characterized by high strength.

The spinning station 1 according to the invention also preferably has a twist-jamming element, which is inserted into the fiber guide element 19, for example. This can be designed as a fiber delivery edge, as a pin, or as another embodiment known from the prior art, and prevents the propagation of a rotation in the fiber bundle 3 opposite the delivery direction of the fiber bundle 3 and, therefore, in the direction of the inlet opening 5 of the fiber guide element 19.

Figure 2:
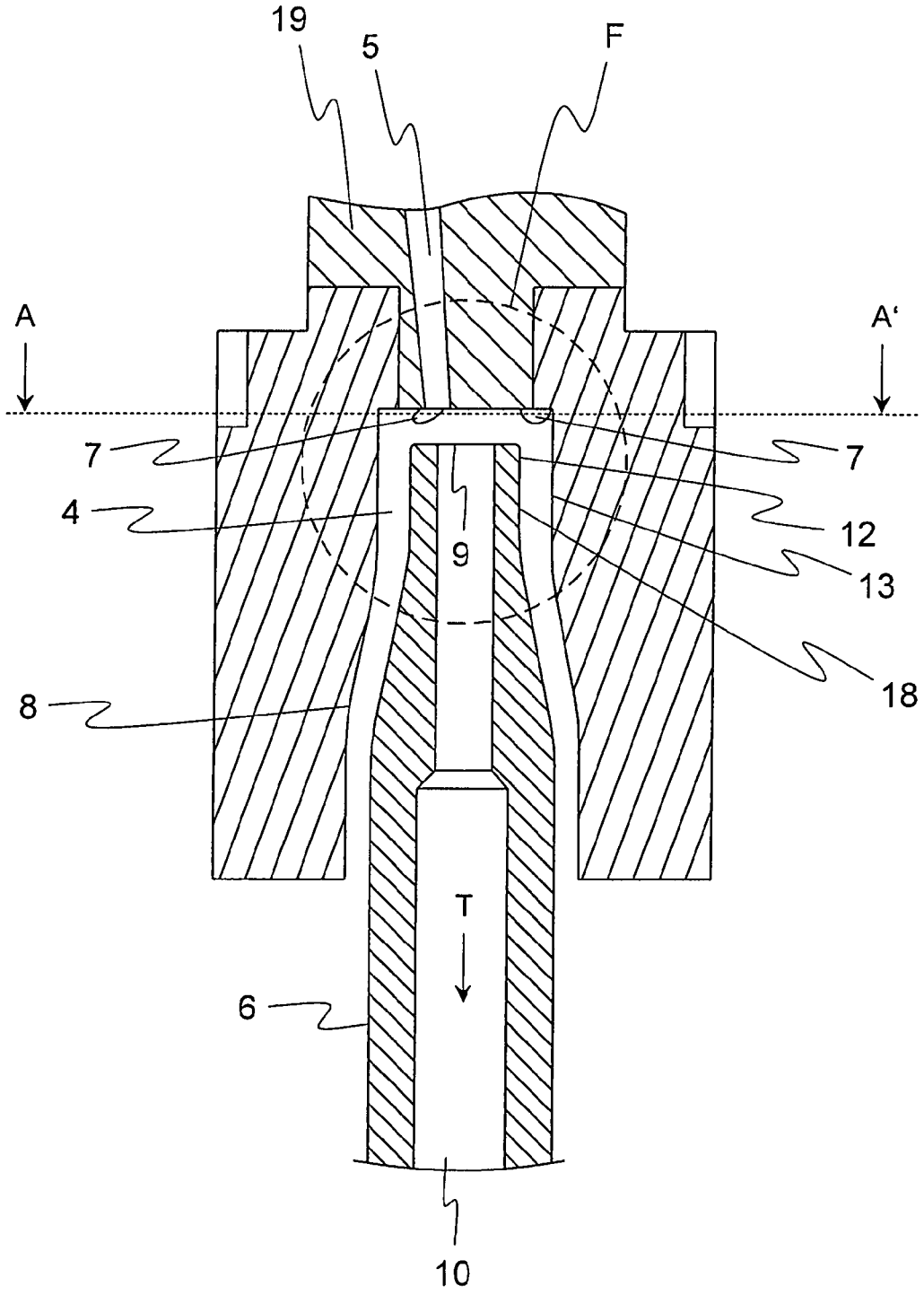
FIG. 2 shows a schematic sectional illustration of a part of a spinning station, cut along the sectional surface B-B' in FIG. 3.
Figure 3:
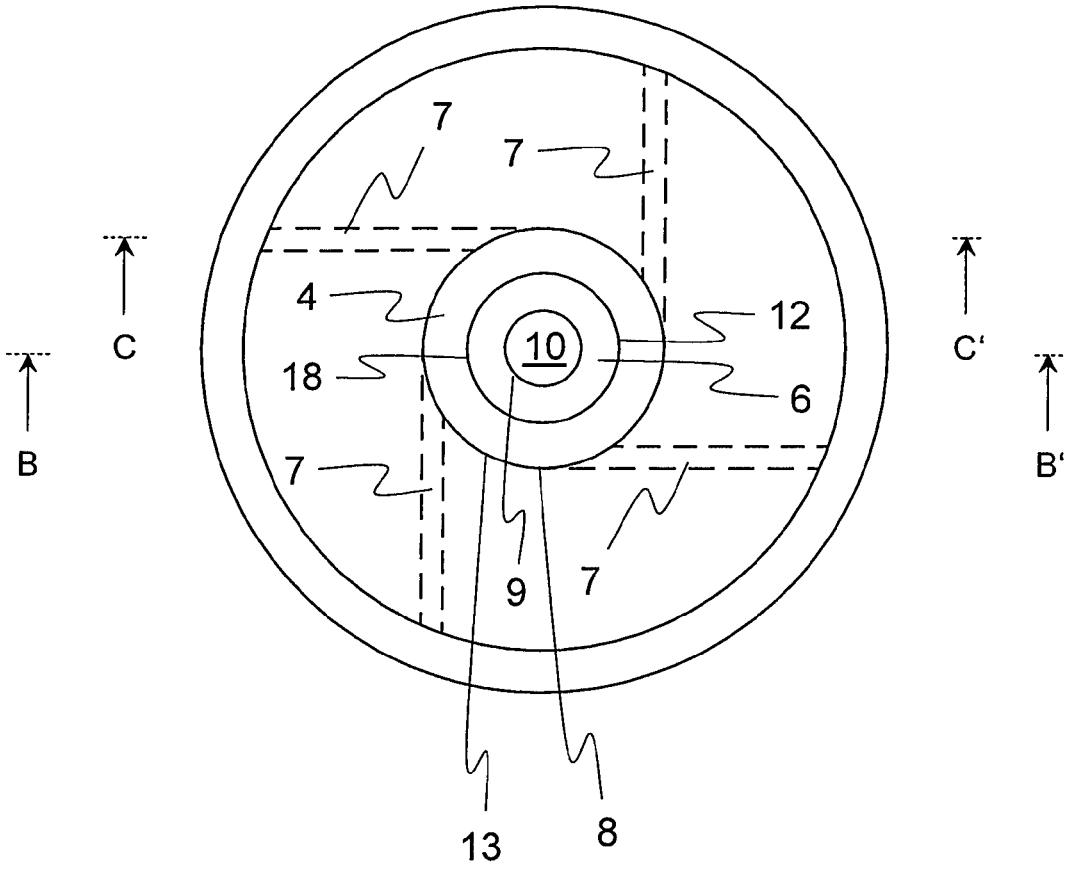
FIG. 3 shows a schematic sectional illustration of a part of a spinning station, cut along the sectional surface A-A' in FIG. 2.
Figure 4:
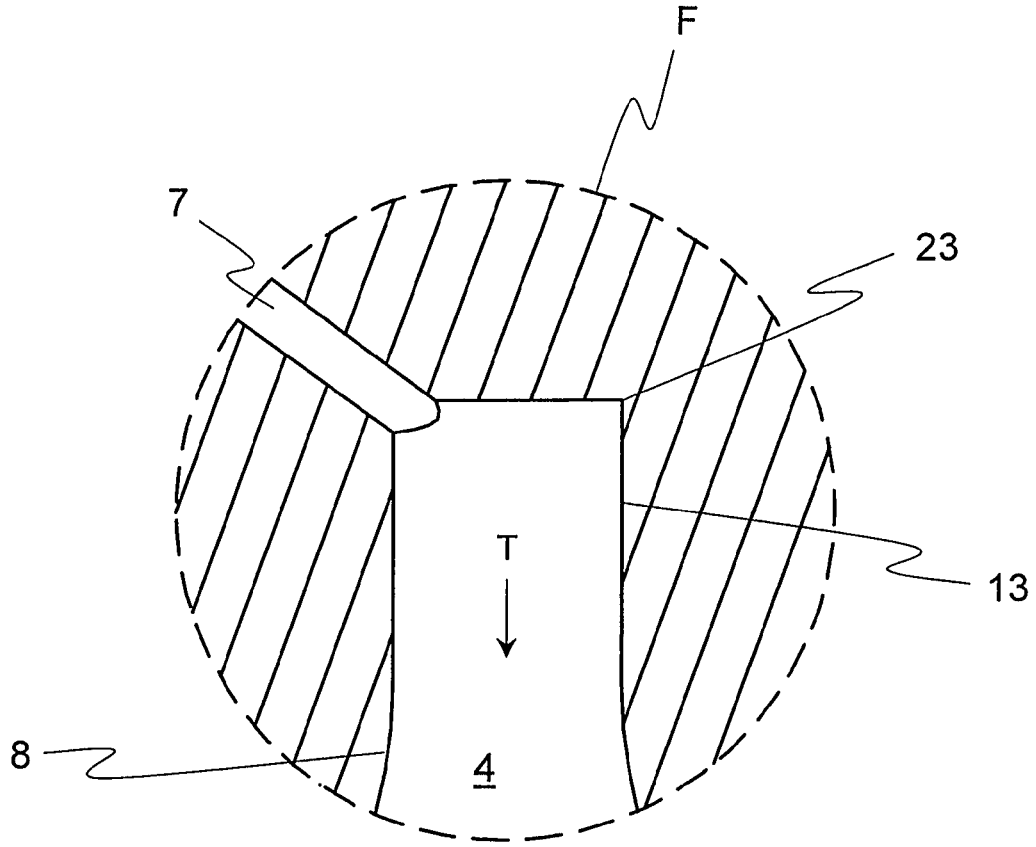
FIG. 4 shows a schematic sectional illustration of the part F in FIG. 2, cut along the sectional surface C-C' in FIG. 3.
Figure 5:
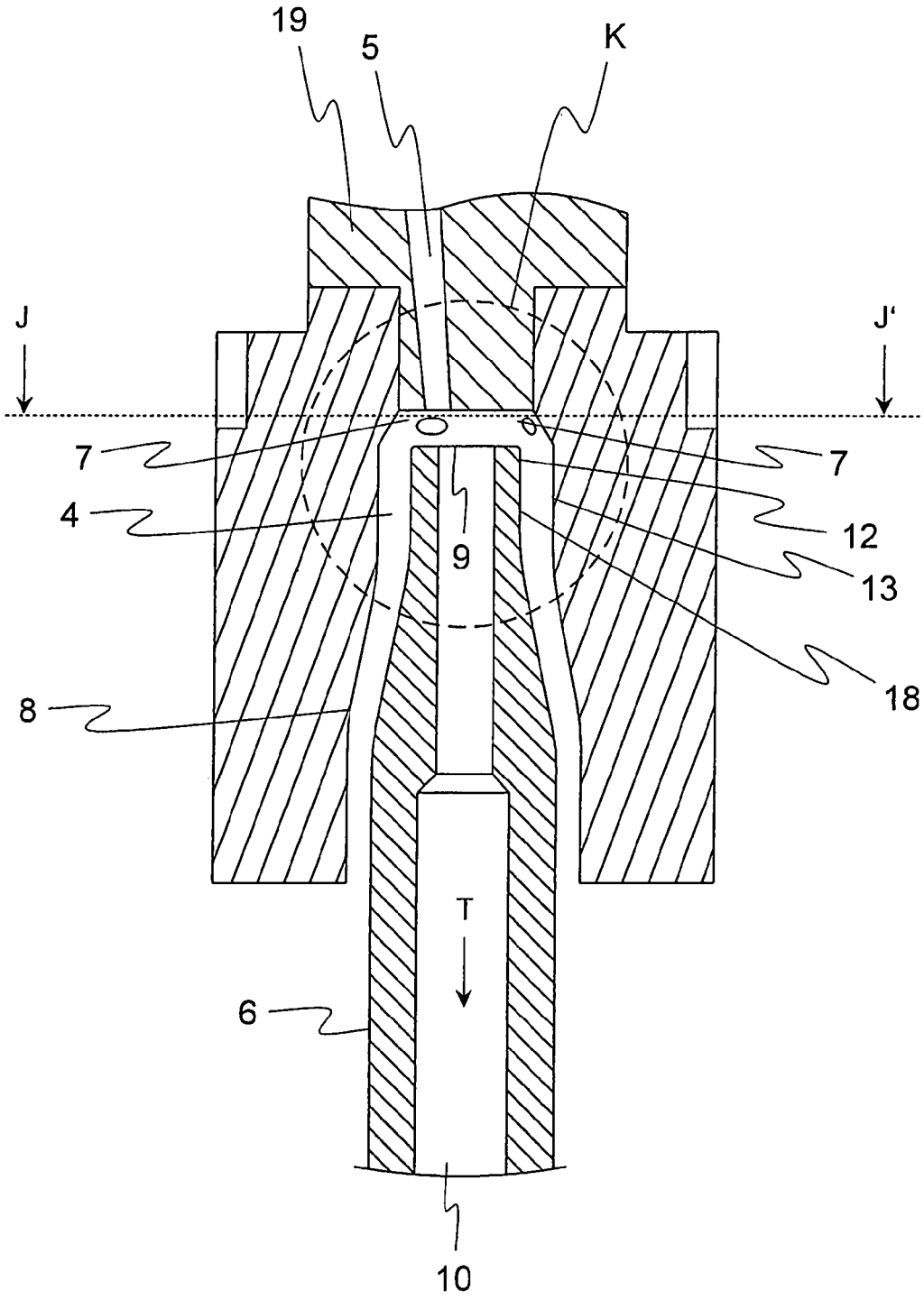
FIG. 5 shows a schematic sectional illustration of a part of a spinning station according to the invention, cut along the sectional surface H-H' in FIG. 8.

As can now be seen from FIGS. 2 to 4 (FIG. 4 shows a sectional illustration of the region F in FIG. 2 along the sectional surface C-C' in FIG. 3), the spin nozzles 7 lead into the vortex chamber 4 in the region of an annular edge 23. Such a geometry is not optimal for the airflow generated by means of the spin nozzles 7, however. The respective outlet openings of the individual spin nozzles 7 transition into the annular edge 23 on both sides, thereby forming a certain stepped transition here. In addition, an upward or downward displacement (as viewed in FIG. 2) of the utilized boring tool that occurs during the production of the spin nozzles 7 results in a change in the flow field of the airflow.

In order to counteract these disadvantages, it is now proposed according to the invention that the wall 8 of the vortex chamber 4 has a transition section 11 adjacent to the infeed opening 5, the shape of which corresponds to the circumferential surface of a truncated cone. Such a design can be seen in the exemplary embodiments according to FIGS. 5 to 13.

Figure 6:
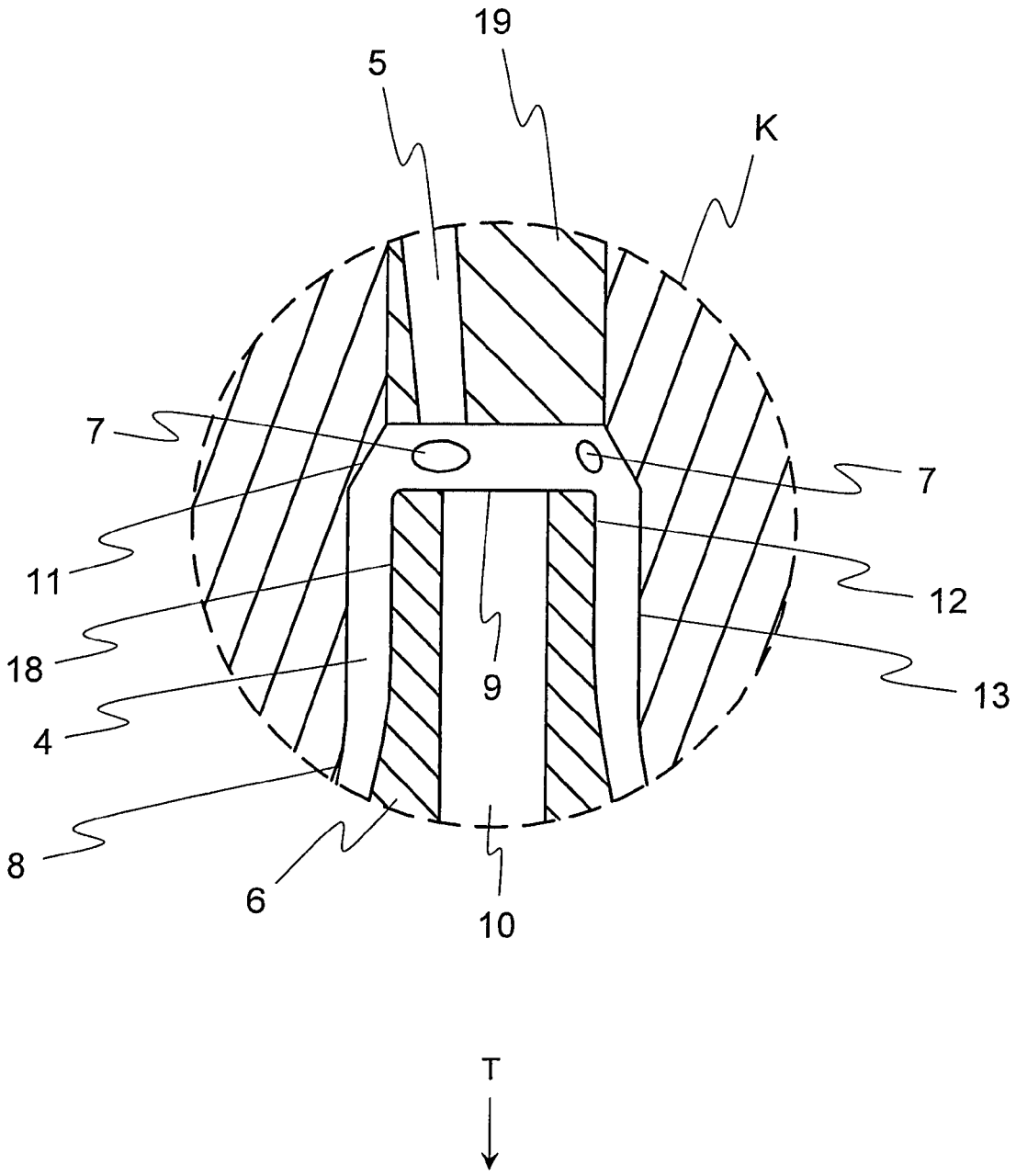
FIG. 6 shows a part of a sectional illustration of a spinning station according to the invention represented by the line K in FIG. 5, cut along the sectional surface H-H' in FIG. 8.
Figure 7:
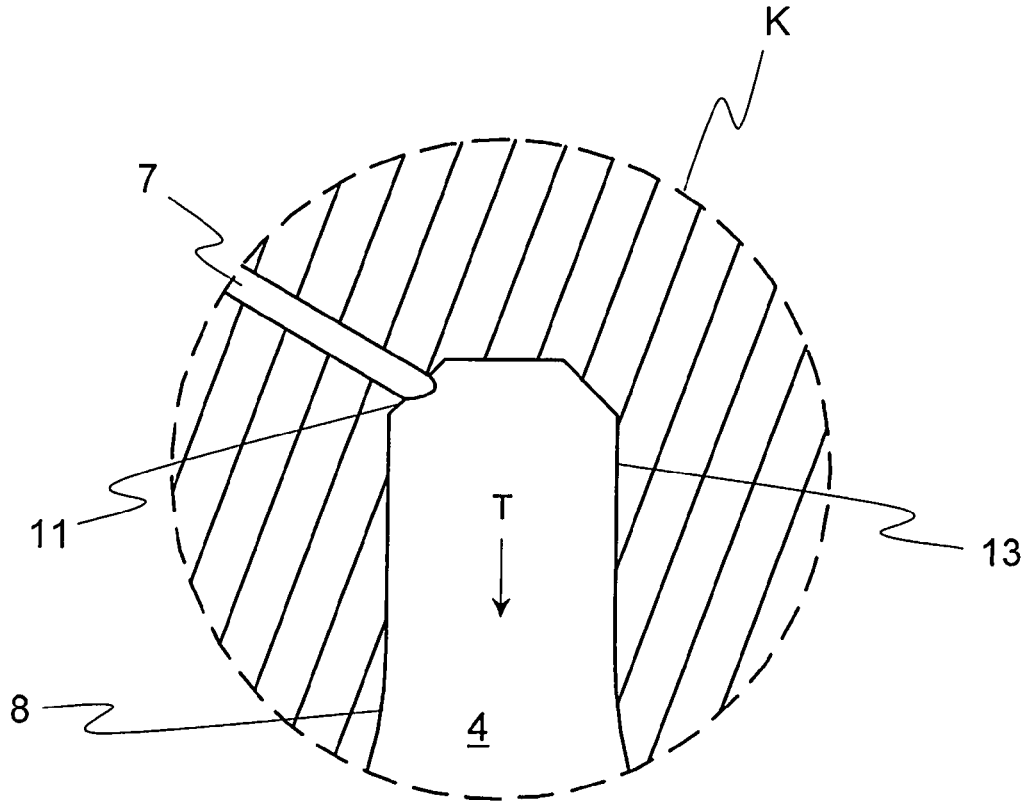
FIG. 7 shows a schematic sectional illustration of the part K in FIG. 5, cut along the sectional surface G-G' in FIG. 8.
Figure 8:
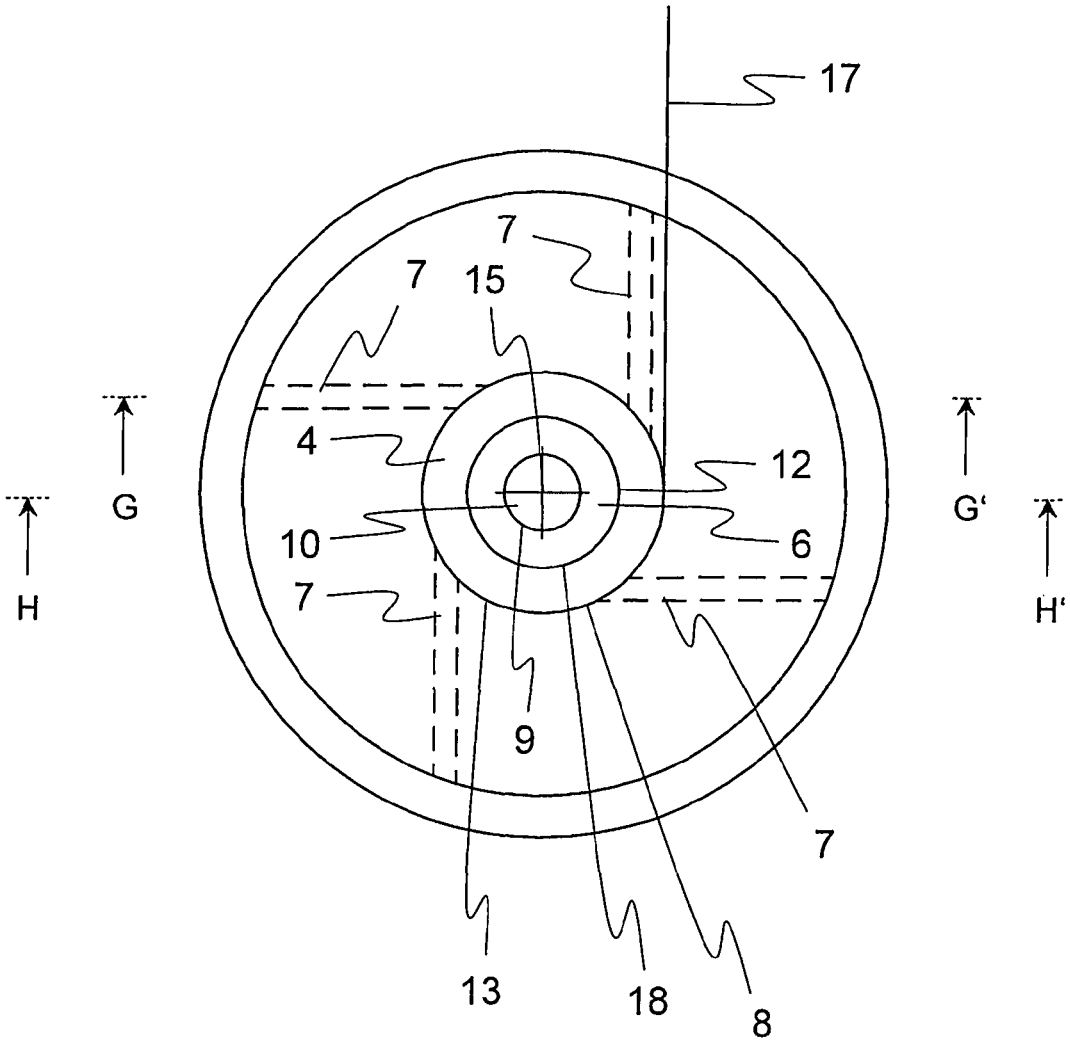
FIG. 8 shows a schematic sectional illustration of a part of a spinning station according to the invention, cut along the sectional surface J-J' in FIG. 5.
Figure 9:
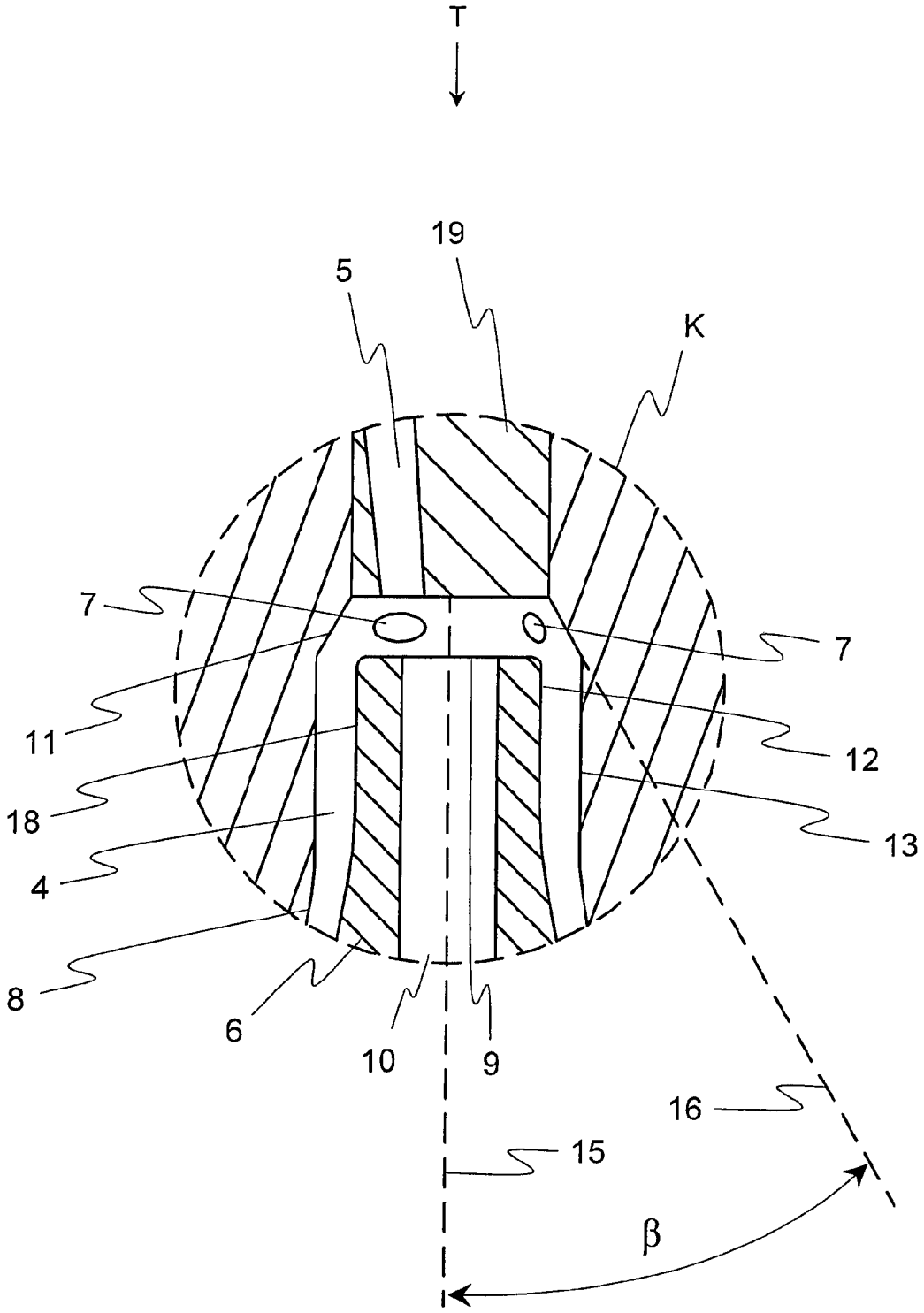
FIG. 9 shows a view corresponding to FIG. 6, with the addition of an angular dimension.
Figure 10:
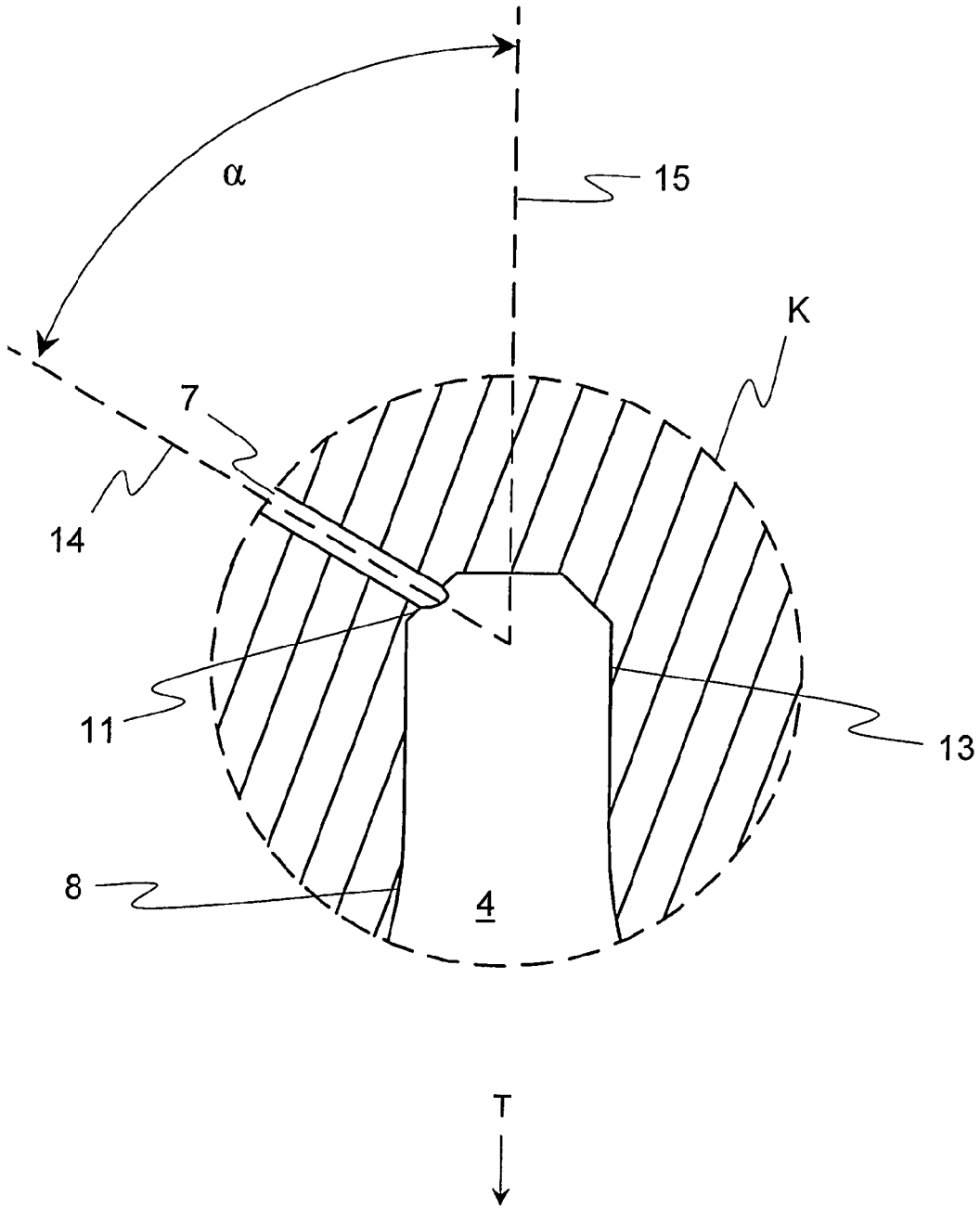
FIG. 10 shows a view corresponding to FIG. 7, with the addition of an angular dimension.

As can be seen, for example, from FIGS. 6 (corresponds to a sectional illustration along the sectional surface H-H' in FIG. 8) and 7 (corresponds to a sectional illustration along the sectional surface G-G' in FIG. 8), it is advantageous when the transition section 11 is designed as a conical annular section. The dimensions of the transition section 11 should be sized such that the air outlet openings of the spin nozzles 7, which are adjacent to the vortex chamber 4, transition into the transition section 11 on all sides. A displacement of the boring tool, which is typically used to produce the spin nozzles 7, does not significantly affect the flow field of the generated airflow in this case.

Moreover, it can be advantageous in general when the transition section 11 transitions into a cylindrical section 13 of the wall 8 of the vortex chamber 4 in the transport direction T. If at least a part of the outer surface 12 of the yarn forming element 6 also has a cylindrical outer contour 18 (see FIG. 6, for example), the vortex chamber 4 has a region adjoining the transition section 11 that has a consistent flow cross-section, which also has a favorable effect on the swirled airflow that is generated.

Independently thereof, FIG. 8 shows that the spin nozzles 7 do not necessarily need to lead tangentially into the vortex chamber 4 (as shown in FIG. 3). Rather, it can be advantageous when the spin nozzles 7 extend so as to be spaced apart from a corresponding tangent line 17, wherein a spin nozzle 7 and a tangent line 17 can extend parallel to one another in each case in the top view shown in FIG. 8 (for the rest, the spin nozzles 7 are indicated with dashed lines in FIG. 8 for explanatory purposes, although they would not actually be seen in the corresponding sectional view; refer to the details provided for FIGS. 2 and 3 for comparison).

Finally, suitably oriented spin nozzles 7 generate an airflow, which does not flow tangentially along the wall 8 of the vortex chamber 4 immediately after it emerges from the respective spin nozzle 7. Rather, it is advantageous when the spin nozzles 7 and, therewith, the generated airflow are oriented in the direction of the wall 8 of the vortex chamber 4 and, therefore, also in the direction of the gap, which is present between the outer surface 12 of the yarn forming element 6 and the wall 8 of the vortex chamber 4.

Finally, advantageous dimensions or angles of spinning stations 1 according to the invention can be seen from the parts that are shown in FIGS. 9 to 13 (wherein it should be expressly noted that the fact that portions of the illustrations are identical does not mean that all the values mentioned in the following must be realized simultaneously).

An airflow that is advantageous for the draftability of the roving 2 results when the angle β (see FIG. 9) between the circumferential line 16 of the transition section 11 and the longitudinal axis 15 of the draw-off channel 10 has a value between 80° and 15°, wherein the value should advantageously be between 40° and 20°. In particular, it has been shown that an angle β of 30° results in an airflow with which a roving 2 can be generated, which has a strength despite the desired draftability that permits the roving 2 to be transported further to a downstream spinning machine.

It is also advantageous when the longitudinal axis 14 of each spin nozzle 7 encloses an angle α (see FIG. 10) with the longitudinal axis 15 of the draw-off channel 10 in a section extending parallel to the respective longitudinal axis 14 and parallel to the longitudinal axis 15 of the draw-off channel 10, said angle α having a value between 75° and 40°. A value between 70° and 50° has proven to be particularly advantageous, wherein, in particular, a value of 60° yields an excellent result in terms of strength and draftability of the roving 2.

In this context, it should finally be noted that it is advantageous when the sum of the two angles α and β yields a value that deviates from 90° as little as possible (a value of 90° is preferred).

Figure 11:
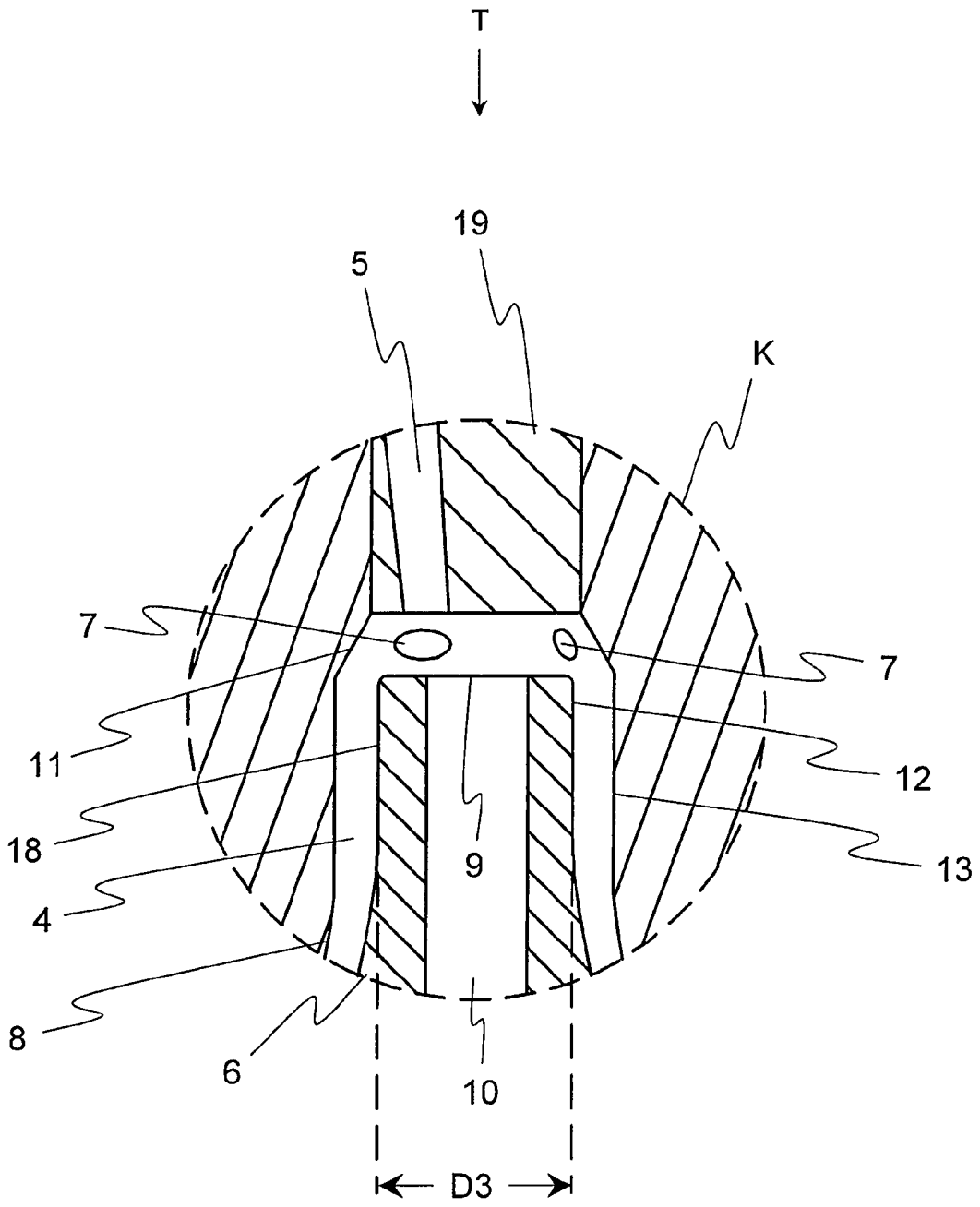
FIGS. 11 through 13 show views corresponding to FIG. 6, with the addition of various dimensions.
Figure 12:
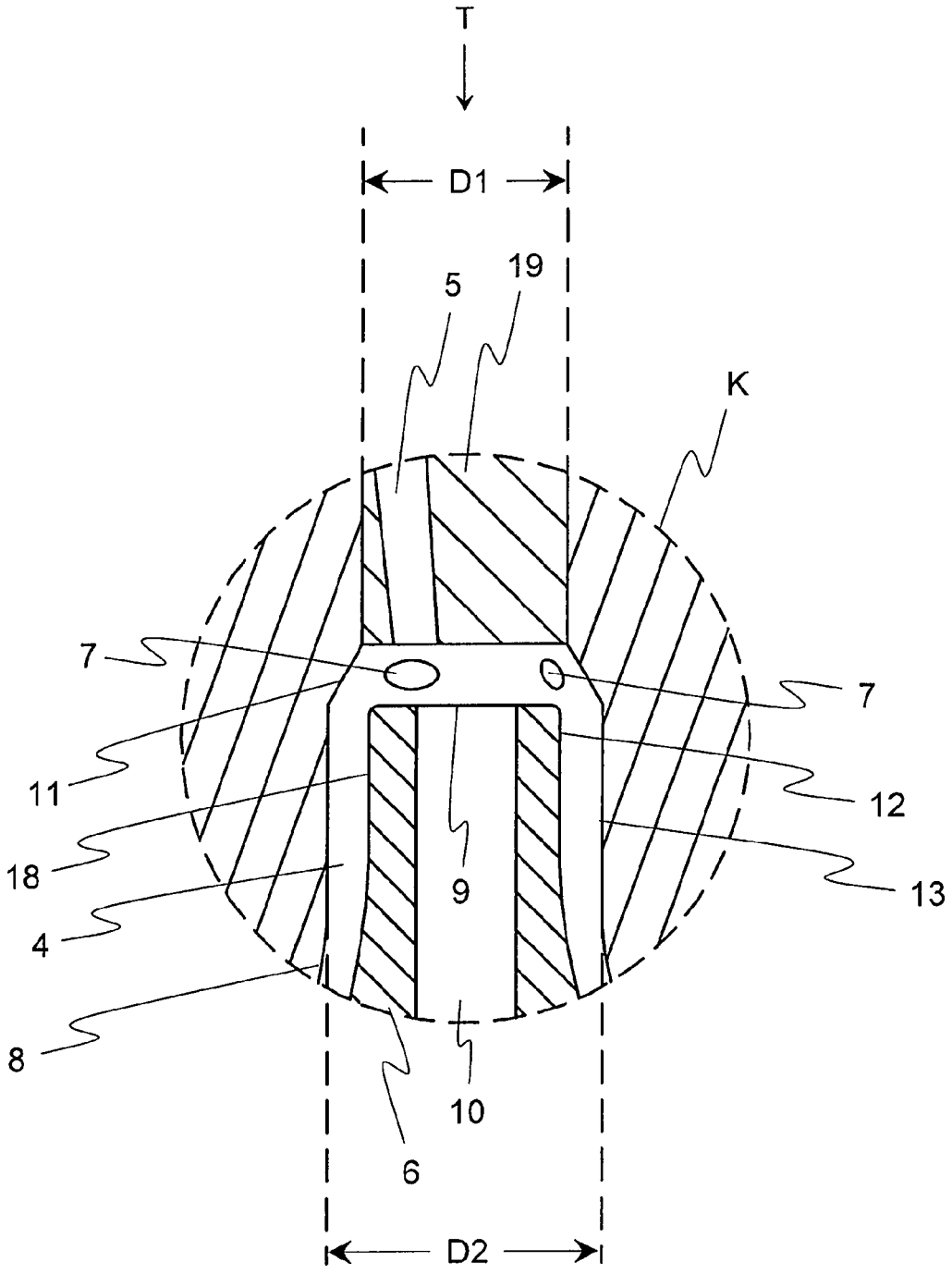
Figure 13:
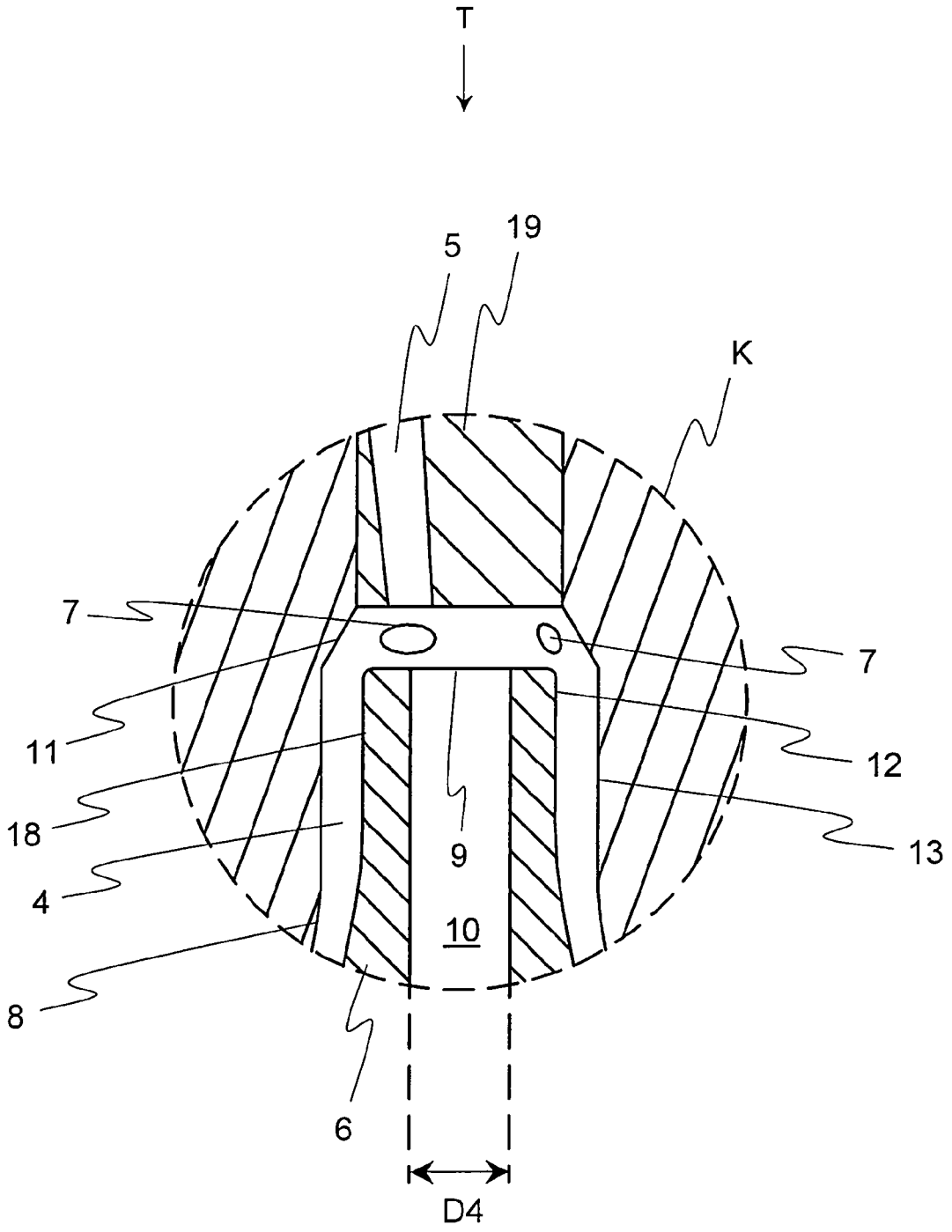

In addition, it was recognized that the selection of the spacings labeled in FIGS. 11 to 13 also influences the quality of the roving 2 produced by means of the respective spinning station 1. The following values have proven to be advantageous in this context:

- Diameter of the transition section 11 on the side thereof facing the infeed opening 5 of the vortex chamber 4 (=D1): between 8 mm and 14 mm, preferably between 9 mm and 12 mm, particularly preferably 10 mm
- Diameter of the transition section 11 on the side thereof facing away from the infeed opening 5 of the vortex chamber 4 (=D2): between 10 mm and 16 mm, preferably between 11 mm and 14 mm, particularly preferably 12.5 mm
- Outer diameter of the yarn forming element 6 in the region in which it has a cylindrical outer contour 18 (=D3): between 5 mm and 14 mm, preferably between 10 mm and 11.5 mm
- Diameter of the inlet mouth 9 of the draw-off channel 10 in the region of the vortex chamber 4 (=D4): between 4 mm and 12 mm, preferably between 6 mm and 8 mm.

Finally, it should be noted that the present invention is not limited to the exemplary embodiments that have been shown and described. Modifications within the scope of the patent claims are also possible, as is any combination of the features, even if they are shown and described in different exemplary embodiments or the general description of the advantages.

The invention claimed is:

1. A spinning station of a spinning preparation machine for producing a roving from a fiber bundle, comprising:

a vortex chamber having an infeed opening for the fiber bundle fed in a transport direction of the fiber bundle;

a roving forming element extending into the vortex chamber and having an inlet mouth;

spin nozzles in a wall enclosing the vortex chamber and directed into the vortex chamber via which air is introduced into the vortex chamber in a specified direction of rotation in order to set the fiber bundle into rotation in the region of the inlet mouth of the yarn forming element;

the roving forming element further comprising a draw-off channel that adjoins the inlet mouth via which the roving is drawn out of the vortex chamber;

the wall of the vortex chamber comprising a transition section that adjoins the infeed opening and has the shape of a circumferential surface of a truncated cone, and a diameter that increases in the transport direction;

wherein the spin nozzles lead into the vortex chamber in the transition section and each have a direction of flow that is oriented towards the wall enclosing the vortex chamber.

2. The spinning station according to claim 1, wherein the transition section transitions into a cylindrical section in the transport direction of the fiber bundle.

3. The spinning station according to claim 1, wherein in a view extending parallel to a longitudinal axis of the draw-off channel, each spin nozzle has a longitudinal axis that defines an angle with the longitudinal axis of the draw-off channel between 75 degrees and 40 degrees.

4. The spinning station according to claim 1, wherein a circumferential line of the transition section viewed in a longitudinal direction defines an angle with a longitudinal axis of the draw-off channel between 80 degrees and 15 degrees.

5. The spinning station according to claim 1, wherein in a sectional view extending perpendicular to a longitudinal axis of the draw-off channel, the spin nozzles extend between the longitudinal axis of the draw-off channel and a tangent line of the wall of the vortex chamber.

6. The spinning station according to claim 1, wherein the transition section has a diameter on a side facing the infeed opening between 14 mm and 8 mm.

7. The spinning station according to claim 6, wherein the transition section has a diameter on a side opposite the infeed opening between 16 mm and 10 mm.

8. The spinning station according to claim 1, wherein the transition section merges into a cylindrical section in the transport direction, and the yarn forming element has a cylindrical outer contour in the region of the cylindrical section.

9. The spinning station according to claim 8, wherein the yarn forming element has an outer diameter at the cylindrical outer contour between 5 mm and 14 mm.

10. The spinning station according to claim 1, wherein the inlet mouth through which roving is pulled out of the vortex chamber has a diameter between 4 mm and 12 mm.

* * * * *